US006814107B2

(12) United States Patent
Schwemmlein et al.

(10) Patent No.: US 6,814,107 B2
(45) Date of Patent: Nov. 9, 2004

(54) DEVICE FOR DETECTING BREAKAGE OF LENO THREADS ON LOOMS OR ON A LOOM MORE SPECIFICALLY PROVIDED WITH HEALD FRAMES AND WITH A DEVICE FOR DETECTING THREAD BREAKAGE

(76) Inventors: Christoph Schwemmlein, Eichengrund 6, Borken-Weseke (DE), 46325; Kurt Hockemeyer, Everhardstrasse 15, Borken-Weseke (DE), 46325

( * ) Notice: Subject to any disclaimer, the term of this patent is extended or adjusted under 35 U.S.C. 154(b) by 198 days.

(21) Appl. No.: 10/159,551

(22) Filed: May 31, 2002

(65) Prior Publication Data

US 2003/0024588 A1 Feb. 6, 2003

(30) Foreign Application Priority Data

Jun. 9, 2001 (DE) ..... 101 28 079
Jul. 11, 2001 (DE) ..... 101 33 800

(51) Int. Cl.[7] ..... D03C 11/00; G01L 5/04

(52) U.S. Cl. ..... 139/54; 139/51; 139/52; 139/50; 139/351; 139/368; 28/185; 28/187; 28/188; 73/160

(58) Field of Search ..... 139/50, 51, 52, 139/54, 351, 352, 353, 354, 368; 66/163, 164; 28/185, 187, 188; 73/160

(56) References Cited

U.S. PATENT DOCUMENTS 2,710,631 A * 6/1955 Flamand ..... 139/54
2,744,544 A * 5/1956 Flamand ..... 139/354
3,158,852 A * 11/1964 Schacher ..... 340/677
3,859,593 A * 1/1975 Poole et al. ..... 324/454
4,166,480 A * 9/1979 Muller ..... 139/54
4,471,816 A * 9/1984 Wada ..... 139/370.2
5,575,313 A * 11/1996 Weber et al. ..... 139/28
5,988,228 A * 11/1999 Krumm ..... 139/54
6,536,643 B2 * 3/2003 Kusuzono et al. ..... 226/11

* cited by examiner

*Primary Examiner*—John J. Calvert
*Assistant Examiner*—Robert H Muromoto, Jr.
(74) *Attorney, Agent, or Firm*—Thomas R. Vigil; Welsh & Katz, Ltd.

(57) ABSTRACT

The device for detecting breakage of leno threads in leno selvedge devices on looms, the leno selvedge forming device being provided with at least two arms for guiding at least two leno threads, the leno threads being twistable together by virtue of the rotation of the arms, the device (12, 13, 14, 14*a*) for detecting thread breakage being provided with a facility (13, 14) for determining the natural oscillations of the arms (12) and a loom, more specifically with heald frames, with at least one leno device which is reversible in its direction of rotation and with a facility for detecting breakage of the leno threads, the device for detecting thread breakage being arranged in the front shed (V), more specifically between the leno device (10) and the heald frames (20).

18 Claims, 6 Drawing Sheets

DEVICE FOR DETECTING BREAKAGE OF LENO THREADS ON LOOMS OR ON A LOOM MORE SPECIFICALLY PROVIDED WITH HEALD FRAMES AND WITH A DEVICE FOR DETECTING THREAD BREAKAGE

CROSS-REFERENCE TO RELATED APPLICATIONS

This application claims priority form German Application Nos. DE 101 28 079.3 filed on Jun. 9, 2001 and DE 101 33 800.7 filed on Jul. 11, 2001.

1. Field of the Invention

The present invention relates to a device for detecting breakage of leno threads in leno selvedge devices on looms, the leno selvedge forming device being provided with at least two arms for guiding at least two leno threads, the threads being twistable together by virtue of the rotation of the arms.

The invention is also directed to a loom with heald frames, with at least one leno device for forming a leno selvedge which is reversible in its direction of rotation and with a facility for detecting breakage of the leno threads.

2. Description of the Prior Art

On its two lateral edges, a woven fabric is provided with what is termed a "leno selvedge". Such a leno selvedge prevents the fabric from fraying. Various apparatuses for forming such a leno selvedge have become known; EP 0 674 031 for example discloses a rotational leno device for looms which is provided with a so-called doup disc having opposite eyelets for guiding the leno threads. A so-called "full leno selvedge" can be formed with this prior art device in that the two leno threads are twisted together about the weft. In order to undo the twisting on the feeding side, it is necessary to reverse the direction of rotation after a certain number of revolutions.

Furthermore, DE 196 47 495 C1 describes a device for forming a full leno selvedge which is characterized by a driven rotating body with diagonally opposite arms, said arms being provided at their ends with eyelets for passing the leno threads therethrough. This device also needs to have the direction of rotation reversed after a certain number of revolutions in order for the threads to be untwisted on the feeding side.

It is known to use so-called "warp thread monitors" for detecting the breakage of the leno threads. Such warp thread monitors are arranged in the back shed between the leno selvedge apparatus and the bearing of the bobbins. Said warp thread monitors are configured as metallic, electrically conductive lamellae that hang from the leno threads.

If a thread breaks, the lamella located on the thread slumps by virtue of its own weight, thus closing an electrical contact, which stops the drive of the loom.

With various threads, monitoring the leno threads by means of lamellae proved impossible. With thin or delicate threads such as fiber glass threads for example, the strain exerted by the lamellae may be so high that they break under the very weight of the lamellae. Therefore, it has become known to monitor the leno threads by means of light barriers, scanners and the like. However, these systems are characterized by poor reliability because of their susceptibility to dust; also, the reaction times are too long.

More specifically when using the leno devices mentioned herein above provided with a facility to reverse the direction of rotation, i.e. with leno devices by means of which the leno threads are twisted on the feeding side, i.e., in the back shed, there is the risk, in utilizing warp thread monitors in the form of lamellae, that the lamellae will not fall down, even upon breakage of the thread, more specifically because the cotton threads are strongly sticking together, thus being capable of still carrying the lamella even in the broken condition of the thread. There is the risk that the broken thread is pulled, together with the other, still intact thread, through the eyelet thereof. Even when the direction of rotation is reversed, i.e., when the leno threads are untwisted on the feeding side, the heald will not fall off.

BRIEF SUMMARY OF THE INVENTION

It is therefore the object of the invention to provide a device of the type mentioned herein above by means of which it is possible to reliably detect thread breakage even on leno devices that are provided with arms and which is reversible in its direction of rotation, i.e., on leno devices that cause the leno threads to be twisted on the feeding side, said threads having to be untwisted again by reversing the direction of rotation.

With a known leno device for forming a leno selvedge in a fabric provided with at least two arms for guiding at least two leno threads, the leno threads being twistable together by virtue of the rotation of the arms, the solution to this object is to suggest that the device for detecting thread breakage is provided with a facility for determining the natural oscillations of the arms. This solution is based on the following consideration:

The arms of the leno device are tensioned by the leno threads that are guided in the eyelets of the arms at the end thereof. While rotating, the arms execute a substantially uniform motion of rotation. The oscillating behavior of the arms is attenuated when the motion of rotation is stopped, this attenuation being effected by the tense guiding of the leno threads in the eyelets of the arms. If the leno thread breaks, the arm, through the eyelet of which no leno thread is guided any longer, is not subjected to any load, thus being without attenuation. As a result thereof, when the corresponding motion of rotation comes to an end, this arm is set oscillating with an oscillation that considerably differs from the oscillation or the pattern of oscillations the arm is subjected to under the load of the leno thread on stopping. The natural oscillating behavior of the arms or the pattern of oscillations resulting therefrom permits to directly assert the condition of the leno threads.

The essential point is that the facility for detecting the oscillating behavior of the arms is not contacting the arms, thus operating in a contactless manner so that the mass of the arms remains unchanged. The mass of the arms is to be kept low if the required high acceleration values are to be realized by the leno device.

More specifically, there is provided that the facility for detecting the oscillating behavior of the arms is provided, in the region thereof, with means for producing a magnetic field, a sensor unit for detecting changes in the magnetic field occasioned by the motion of the magnetically conductive arms of the leno device being provided for and an evaluation unit being provided that compares the oscillation spectra of the natural oscillations produced by the arms when the thread is broken and when it is intact, a signal delivery unit being arranged downstream of said evaluation unit. The rotation of the magnetically conductive arms allows the magnetic field to vary, the extent of variation of the magnetic field reflecting the oscillating behavior of the arms. That is to say that the pattern of oscillations corresponding to the motion of the arms accordingly produces a corresponding signal in the coil, or in the Hall sensor. These signals, which correspond to the patterns of oscillations of the arms under the condition of a broken or an intact thread, are next compared in the evaluation unit, an assertion being made, upon comparison, about whether the leno thread is broken or intact. In function of the result of said comparison, a signal delivery unit sends a signal to the drive of the loom for the purpose of stopping the loom if necessary. A variant is conceivable in which the arms are magnetized as well or in which permanent magnets for producing a magnetic field are arranged on said arms.

The very sensor unit can be provided with means allowing for inductive or capacitive operation and adapted to detect the oscillation of the arms of the leno device. Means allowing for capacitive operation and adapted to detect oscillations or the pattern of oscillations are a capacitor, a voltage change occurring in the capacitor at a certain frequency in function of the motion of the arms. It is also an object of the invention to provide a loom characterized by a device having one or several features of the device for detecting thread breakage described herein above, said device for detecting thread breakage being advantageously arranged in the front shed between the leno device and the heald frames.

Another subject matter of the invention is a loom, more specifically provided with heald frames, with at least one leno device which is reversible in its direction of rotation and with a facility for detecting breakage of the leno threads. As already explained herein above, it has become known to monitor breakage of the leno threads in the region of the back shed. This involves different difficulties and it has particularly to be stressed that in case of threads that are strongly sticking together, like e.g. cotton threads, it is not made certain that, even when the thread has broken in the region of the back shed, lamellae configured as warp thread monitors will indeed fall down, thus causing the drive of the loom to stop as desired.

It is therefore the object of the invention to arrange, on a loom of the type mentioned herein above and provided with a leno device which is reversible in its direction of rotation, a device for detecting breakage of leno threads in such a manner that the operation of the facility for detecting breakage of leno threads is not impaired by the twisting of the thread in the back shed.

The solution to this object in accordance with the invention is to arrange the device for detecting thread breakage in the front shed, more specifically between the heald frames and the leno device. In the front shed, undesirable twisting of the threads without weft does not take place in front of the heald frames. Accordingly, the device for detecting thread breakage can be arranged there without its function being affected in any way by the twisting of the leno threads, as it is the case when it is located in the back shed.

More specifically, there is provided that the device for detecting thread breakage is not connected to the leno threads, i.e., it is configured as a device operated in a contactless manner. Conceivable are sensors operated in a contactless manner in particular like for example light barriers, scanners, and the like. Such a sensor unit for detecting thread breakage is advantageously connected to an evaluation unit and/or directly with a signal delivery unit, the drive of the loom being controllable, i.e., in case of doubt, stoppable by said signal delivery unit.

The invention is explained herein after in more detail with reference to the drawing.

DETAILED DESCRIPTION OF THE INVENTION

Figure 1:
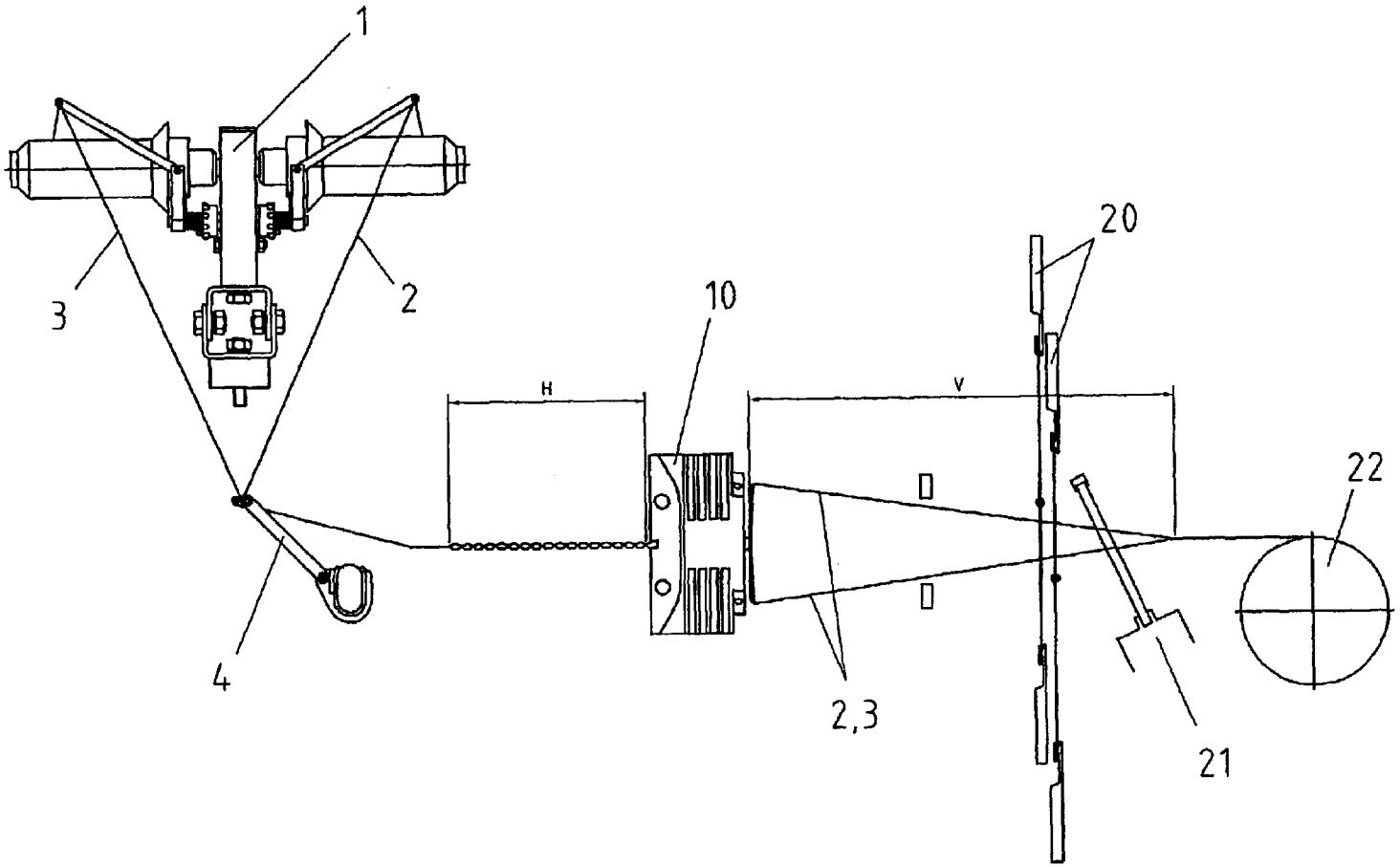
FIG. 1 shows the schematic arrangement of the leno device on a loom.
Figure 2:
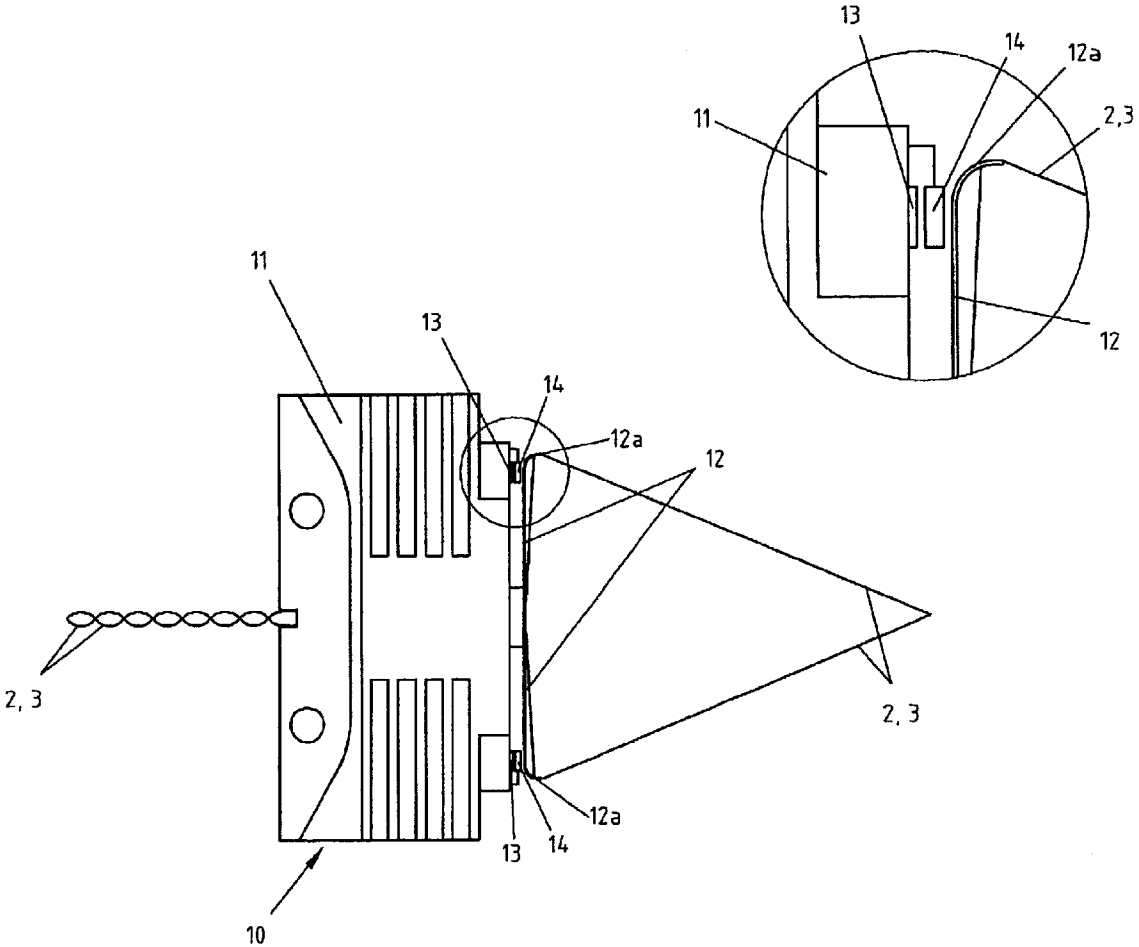
FIG. 2 is an enlarged representation of the leno device of FIG. 1 with an enlarged detail showing the essential features.
Figure 3:
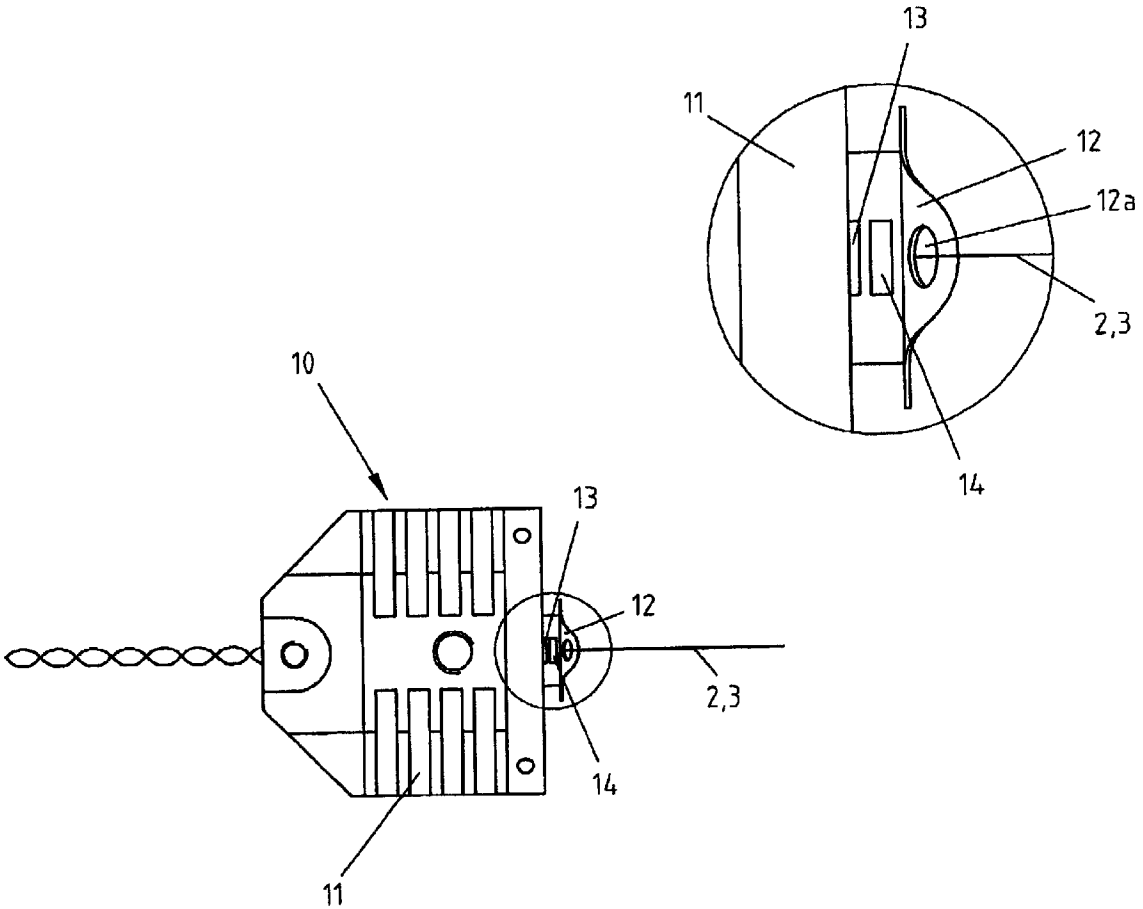
FIG. 3 is a top view of the leno device of FIG. 2 with an enlarged detail showing the essential features.
Figure 5:
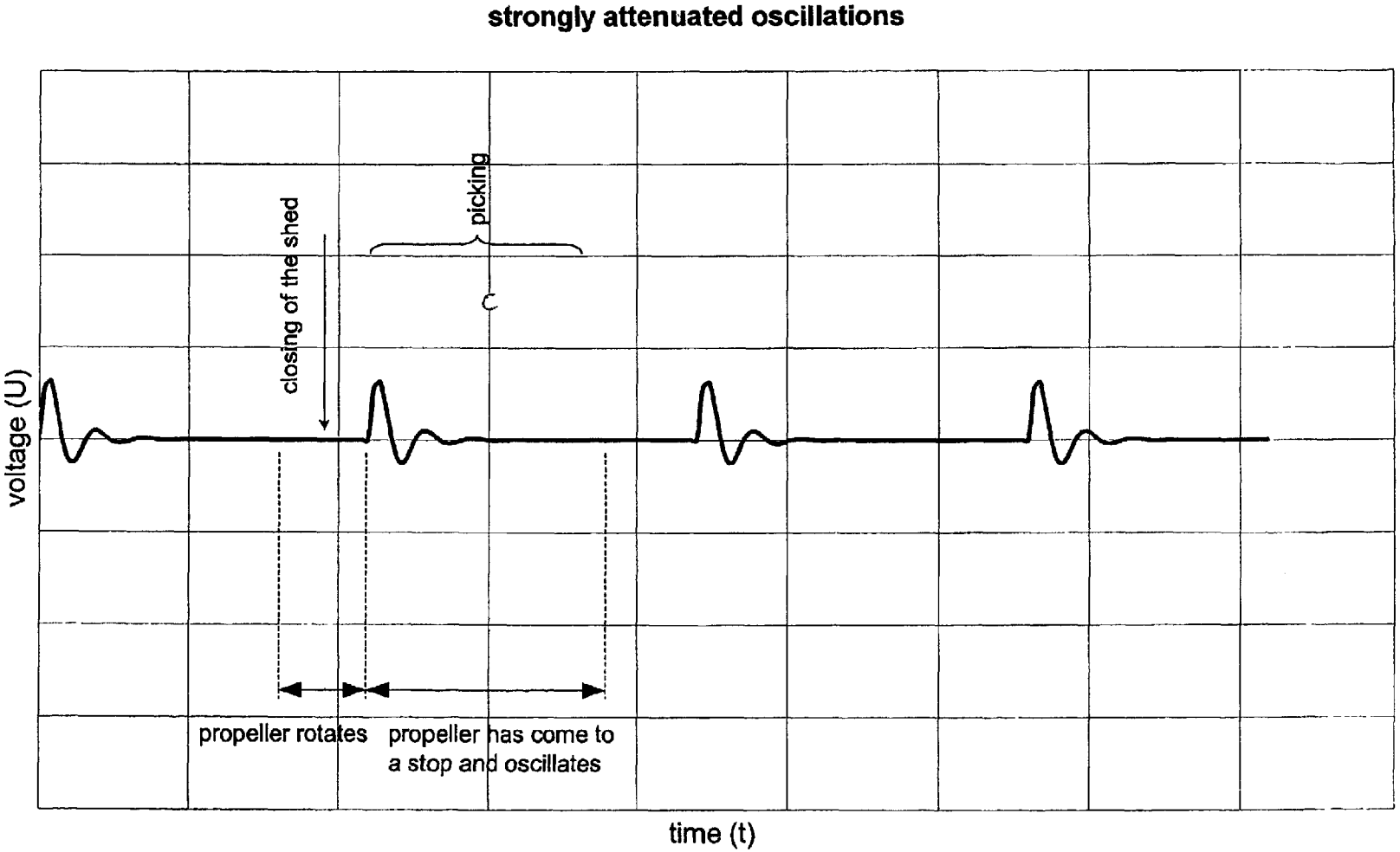
FIG. 5 illustrates the pattern of oscillations of the arms when they are subject to strong attenuation by virtue of the tension of the leno thread.
Figure 6:
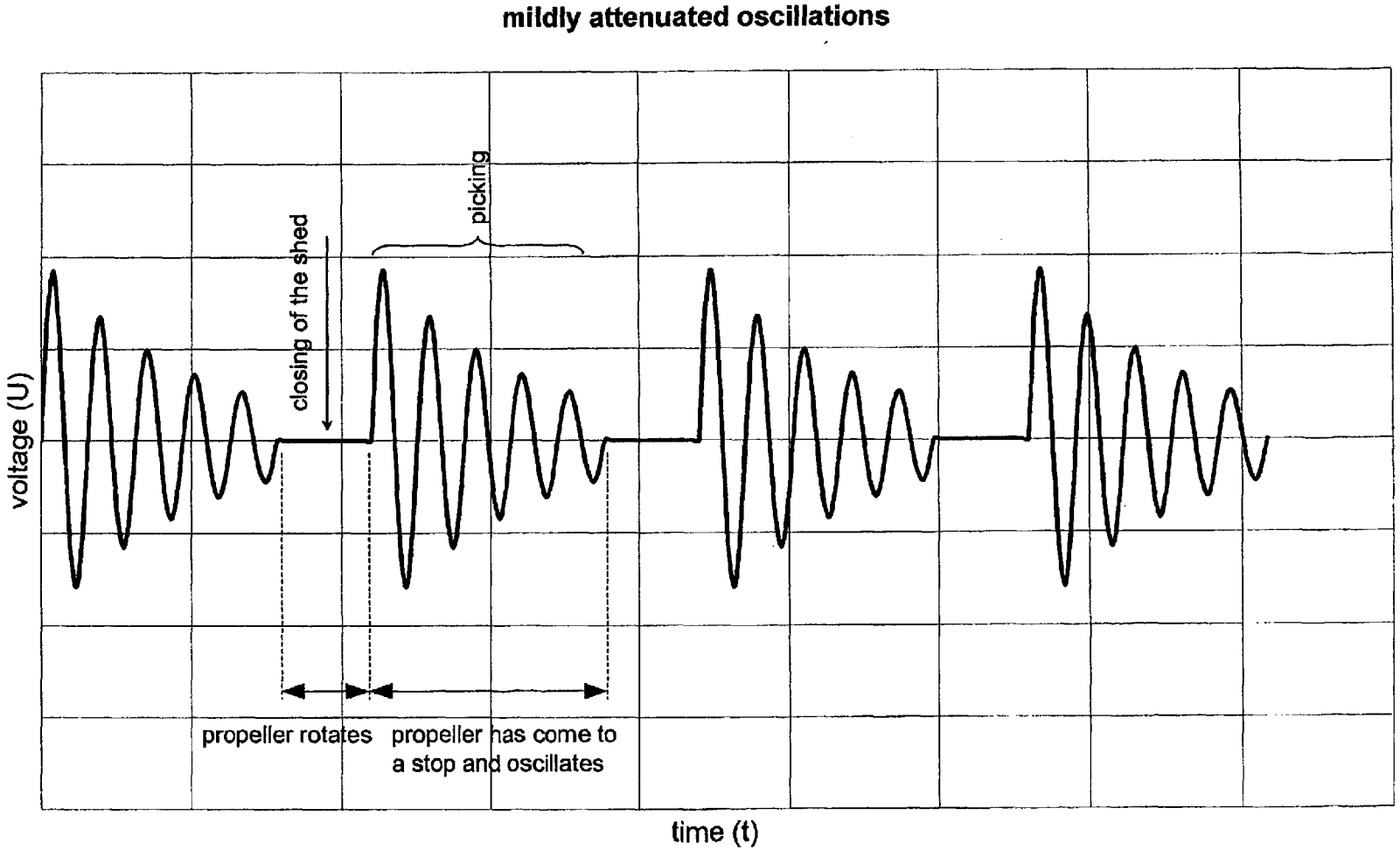
FIG. 6 shows the pattern of oscillations of FIG. 5 in case of mild attenuation by the leno thread.

The bobbin-holder, which is indicated generally at 1 and from which the two leno threads 2 and 3 are unwound, can be surveyed from FIG. 1. The two leno threads 2 and 3 are kept under tension and deviated by the device for holding down the thread 4. The two leno threads 2, 3 are led to the leno device indicated at 10 on the back side, i.e., in the region of the back shed H. Downstream of the leno device 10, there are arranged the heald frames 20, the reed 21 and the beam 22, which receives the fabric. The front shed V extends from the point at which the leno threads are twisted with the weft to the leno device. The leno device 10 is provided with the motor drive 11 and with the two diagonally opposite arms 12, which thus form a "propeller". At their ends, the arms have eyelets 12*a* for passing the leno threads 2, 3 through. At least two magnets 13 are provided on the casing of the motor 11 and, to the back of a respective one of said magnets, there is arranged one sensor unit 14 each that is configured as a coil, a Hall sensor or a capacitor. Advantageously, the magnet, the sensor and the arms 12 of the leno device 10 are arranged in series at standstill. In this case, the sensor can acquire a clean and interference-free signal of the pattern of oscillations generated when the arm is under the tension of the leno thread, that is, when its natural oscillation is attenuated or when the leno thread has broken and the natural oscillation of the arm is substantially not attenuated. The different oscillation or frequency spectrum of the attenuated oscillation of the arms can additionally be considered for evaluation on account of the tension of the leno thread. The FIGS. 5 and 6 illustrate how such a pattern of oscillations is configured when the leno thread is intact or broken. Methods such as fuzzy logic for example can be additionally utilized.

Figure 4:
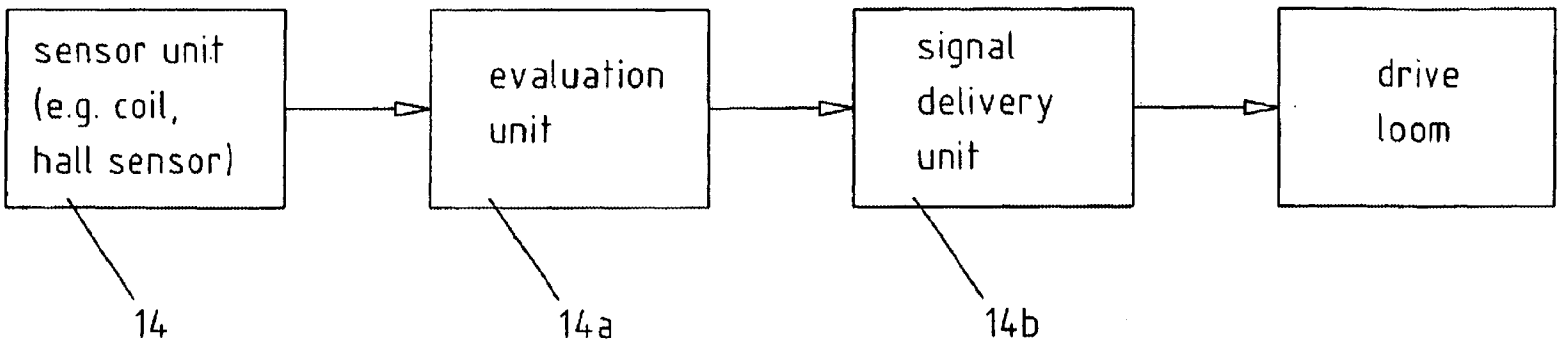
FIG. 4 illustrates the facility for detecting the oscillating behavior which is comprised of a sensor unit, an evaluation unit and a signal delivery unit.

It can be surveyed from FIG. 4 that the sensor unit 14, a coil for example, or a Hall sensor as a sensor allowing for inductive operation, or a capacitor detects the variation in the magnetic field as a frequency spectrum, and that the attenuation or the pattern of oscillations effected by the attenuation and/or the oscillation spectrum in case of a broken leno thread is compared with those of an intact leno thread in an evaluation unit 14*a*, a signal for stopping the drive of the loom being then delivered by the signal delivery unit 14*b* in function of the result of the comparison.

What is claimed is:

1. A device for detecting breakage of leno threads in leno selvedge devices on looms, the leno selvedge forming device being provided with at least two arms for guiding at least two leno threads, the leno threads being twistable together by virtue of the rotation of the arms, characterized in that the device (12, 13, 14, 14*a*) for detecting thread breakage is provided with a mechanism (13, 14) for determining the natural oscillations of the arms (12).

2. The device according to claim 1, characterized in that the mechanism (13, 14) for determining the natural oscillations of the arms (12) is not contacting said arms (12).

3. The device according to claim 2, characterized in that the attenuation or the pattern of oscillations and/or the oscillation spectrum of the arms (12) is detected with broken and intact leno threads (2, 3) at standstill, once the rotation has come to an end.

4. The device according to claim 3, characterized in that the mechanism (13, 14) for detecting the oscillating behavior is provided, in the region of the arms (12), with means (13) for producing a magnetic field, a sensor unit (14) for detecting changes in the magnetic field occasioned by the motion of the magnetically conductive arms (12) of the leno device (10) being provided for and an evaluation unit (14*a*) being provided that compares the oscillation spectra or the attenuation of the oscillations produced by the arms (12) when the leno thread (2, 3) is broken and when it is intact, a signal delivery unit (14*b*) being arranged downstream of said evaluation unit (14*a*).

5. The device according to claim 4, characterized in that the signal delivery unit (14*b*) is connected to the drive of the loom.

6. The device according to claim 3, characterized in that the signal delivery unit (14*b*) is connected to a display device.

7. The device according to claim 4, characterized in that permanent magnets for producing the magnetic field are provided on the arms (12).

8. The device according to claim 4, characterized in that the sensor unit (14) is provided with means for detecting the attenuation or the oscillation spectrum that allow for inductive operation such as a coil or a Hall sensor, or for capacitive operation.

9. A loom, more specifically with heald frames, with at least one leno device which is reversible in its direction of rotation and with a mechanism for detecting breakage of the leno threads, characterized in that the device for detecting thread breakage is arranged in the front shed (V), more specifically between the leno device (10) and the heald frames (20); and the device is provided with a mechanism (13,14) for determining the natural oscillations of the arms (12).

10. The loom according to claim 9, characterized in that the device (12, 13, 14, 14*a*) for detecting thread breakage is not connected to the leno threads (2, 3).

11. The loom according to claim 9, characterized in that the device (12, 13, 14, 14*a*) for contactless detection of thread breakage is provided with a sensor unit (14) for acquiring thread breakage.

12. The loom according to claim 11, characterized in that the sensor unit (14) is connected to a signal delivery unit (14*b*), the drive of the loom being controllable by said signal delivery unit (14*b*).

13. A loom including a device according to claim 1.

14. A loom according to claim 13 characterized in that the mechanism for determining nature oscillations of the arms does not contact the arms.

15. The loom according to claim 14 wherein the attenuation of the oscillations is detected with broken and intact leno threads at standstill, once the rotation of the arms has stopped.

16. The loom of claim 15 wherein the mechanism for detecting the oscillation behavior is provided, in the region of the arms, with means for producing a magnetic field, a sensor unit for detecting changes in the magnetic field occasioned by the motion of the magnetically conductive arms of the leno device being provided, an evaluation unit being provided that compares the attenuation of the oscillations produced by the arms when the leno thread is broken and when it is intact, and a signal delivery unit being arranged downstream of said evaluation unit.

17. The loom accordingly to claim 16, wherein the sensor unit is provided for detecting the attenuation of the oscillation which provides for inductive operation by means of one of a coil, a hall sensor or a capacitive coupling.

18. The loom according to claim 13, including heald frames, at least one leno device which is reversible in its rotation of direction and the mechanism for detecting breakage of leno threads being arranged in a front shed (V) between the leno device and the held frames.

* * * * *